US008005403B2

(12) United States Patent
Yamanaka et al.

(10) Patent No.: US 8,005,403 B2
(45) Date of Patent: Aug. 23, 2011

(54) IMAGE FORMING APPARATUS WITH MOVABLE DEVELOPING UNIT

(75) Inventors: Takayuki Yamanaka, Osaka (JP); Masayasu Narimatsu, Osaka (JP); Hideji Saikoh, Osaka (JP); Junichi Saito, Osaka (JP); Eiichi Kido, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/707,132

(22) Filed: Feb. 17, 2010

(65) Prior Publication Data

US 2010/0209146 A1 Aug. 19, 2010

(30) Foreign Application Priority Data

Feb. 17, 2009 (JP) ..... 2009-034073

(51) Int. Cl.
*G03G 15/01* (2006.01)

(52) U.S. Cl. ..... 399/228

(58) Field of Classification Search ..... 399/107, 399/110, 119, 120, 222, 223, 226, 228
See application file for complete search history.

(56) References Cited

U.S. PATENT DOCUMENTS

| | | | | |
|---|---|---|---|---|
| 5,202,739 | A * | 4/1993 | Hatakeyama et al. | 399/226 |
| 6,094,554 | A | 7/2000 | Ichikawa et al. | |
| 6,151,474 | A | 11/2000 | Ichikawa et al. | |
| 6,163,674 | A | 12/2000 | Ichikawa et al. | |
| 6,192,209 | B1 | 2/2001 | Ichikawa et al. | |
| 6,198,893 | B1 | 3/2001 | Ichikawa et al. | |
| 6,226,484 | B1 | 5/2001 | Ichikawa et al. | |
| 6,295,433 | B1 | 9/2001 | Ichikawa et al. | |
| 6,336,022 | B2 | 1/2002 | Ichikawa et al. | |
| 7,813,666 | B2 * | 10/2010 | Sato | 399/90 |

FOREIGN PATENT DOCUMENTS

| | | |
|---|---|---|
| JP | 61-243473 | 10/1986 |
| JP | 1-108572 | 4/1989 |
| JP | 05-297696 | 11/1993 |
| JP | 8-278698 | 10/1996 |
| JP | 9-171300 | 6/1997 |
| JP | 9-274386 | 10/1997 |
| JP | 10-240009 | 11/1998 |
| JP | 11-231643 | 8/1999 |
| JP | 2001-318530 | 11/2001 |
| JP | 2004-20855 | 1/2004 |
| JP | 2006-91323 | 4/2006 |
| JP | 2006-106184 | 4/2006 |

OTHER PUBLICATIONS

Japanese Office Action issued in JP 2009-034073 on Feb. 1, 2011.
Japanese Office Action issued in JP 2009-034073 on Apr. 5, 2011.

* cited by examiner

*Primary Examiner* — Hoan Tran
(74) *Attorney, Agent, or Firm* — Nixon & Vanderhye, PC

(57) ABSTRACT

An image forming apparatus includes: a latent image bearing member on which an electrostatic latent image is to be formed; a developing unit which contains the developer and performs a development process to develop the electrostatic latent image formed on the latent image bearing member; and a movement mechanism which moves the developing unit toward the latent image bearing member when the development process is performed, and moves the developing unit away from the latent image bearing member and changes the attitude of the developing unit with, respect to the latent image bearing member when the development process is not performed.

12 Claims, 5 Drawing Sheets

IMAGE FORMING APPARATUS WITH MOVABLE DEVELOPING UNIT

CROSS-REFERENCE TO RELATED APPLICATIONS

This application is related to Japanese application No. 2009-034073 filed on Feb. 17, 2009, whose priority is claimed under 35 USC §119, the disclosure of which is incorporated by reference in its entirety.

BACKGROUND OF THE INVENTION

1. Field of the Invention

The present invention relates to an image forming apparatus and, more specifically, to an electrophotographic image forming apparatus which is adapted to form an image by developing an electrostatic latent image formed on a latent image bearing member with a developer.

2. Description of the Related Art

In an electrophotographic image forming apparatus such as a copying machine or a printer, an electrostatic latent image corresponding to an image to be formed on a sheet-shaped recording medium is formed on a surface of a photosensitive member serving as a latent image bearing member. The image forming apparatus includes a developing unit which supplies a developer such as a toner serving as a colorant to the photosensitive member and causes the toner to selectively adhere to the electrostatic latent image for visualization of the electrostatic latent image formed on the surface of the photosensitive member.

A toner image formed on the surface of the photosensitive member through the development by the developing unit is transferred onto the sheet-shaped recording medium. Then, the recording medium having the toner image transferred thereon is passed through a fixing unit in which the toner image is heated to be fused. The fused toner image is fixed to the recording medium.

After the transfer, a part of the toner not transferred onto the recording medium remains on the surface of the photosensitive member. The residual toner is removed from the surface of the photosensitive member for the next image formation. Therefore, a cleaning unit which removes the unnecessary residual toner from the surface of the photosensitive member is provided adjacent to the photosensitive member. The removed residual toner is stored in a container of the cleaning unit.

Methods for the development of the electrostatic latent image with the use of a dry developer are broadly classified into the following two categories: a two-component development method which employs a two-component developer including a magnetic carrier and a toner; and a single-component development method which employs a single-component developer including a toner alone.

In the two-component development method, the two-component developer including the toner and the magnetic carrier is carried on a surface of a developing roller serving as a developer carrying member by utilizing a magnetic force of a magnet incorporated in the developing roller, and transported to a developing area opposed to the photosensitive member by rotating the developing roller. When the developer is transported to the developing area, the charged toner contained in the developer electrostatically adheres to the electrostatic latent image on the surface of the photosensitive member, whereby the electrostatic latent image is developed. A residual part of the developer passed through the developing area is fed back into the developing unit, and magnetically released from the surface of the developing roller to be thereby collected in a developer tank of the developing unit. For stable development in the two-component development method, a virgin toner should be additionally supplied to the developing unit according to consumption of the toner, so that the proportion of the toner in the developer, i.e., the concentration of the toner, is kept constant.

In the two-component development method, an agitating mechanism such as an auger mechanism is generally provided in the developer tank of the developing unit for triboelectrically charging the toner by friction between the carrier and the toner. Therefore, the two-component development method is less susceptible to stagnation of the developer in the developer tank, but the developer tank has some dead space in which the developer is not easily circulated. That is, the stagnation of the developer is liable to occur in a portion of the developer tank in which an agitating force is weak and, particularly, in a portion of the developer tank adjacent to an area at which the developer is released from the surface of the developing roller.

In the single-component development method, on the other hand, there is no need to control the toner concentration.

Also, since mixing the carrier with the toner through the agitation in the developer tank as needed in the two-component development method is not required, the single-component development method does not need to provide a complicated agitation mechanism such as an auger mechanism, but is merely required a simple mechanism for supplying the toner to the developer carrying member.

That is, the single-component development method does not require the carrier, making it possible to correspondingly reduce the volume of the developer tank and hence the size of the developing unit. And further, the single-component development method ensures easier maintenance.

On the other hand, since the agitating mechanism is not provided in the single-component development method, the developer is poorly circulated in the developer tank as compared with the two-component development method.

In order to prevent the poorer circulation of the developer in the developer tank, a developer container is proposed which is divided into two chambers communicating with each other and includes a screw for circulating the toner between the two chambers (see, for example, Japanese Unexamined Patent Publication No. HEI8(1996)-278698).

In view of an opposed relationship of the latent image bearing member and the developer carrying member, the following difference is observed between the two-component development method and the single-component development method.

That is, in the two-component development method, the latent image bearing member and the developer carrying member are spaced a predetermined distance from each other in opposed relation, and a height of a magnetic brush formed by the developer carried on the developer carrying member is restricted to a predetermined level greater than the aforementioned distance by a developer amount restricting member. The latent image is developed, while a distal edge portion of the magnetic brush is kept in sliding contact with the surface of the latent image bearing member.

On the other hand, the single-component development method includes a contact development method and a non-contact development method. In the contact development method, a layer of the developer carried on the developer carrying member is restricted to a predetermined thickness and it is brought into contact with the latent image bearing member for the development. In the non-contact development method, the developer layer carried on the developer carrying member is spaced a predetermined distance from the surface of the latent image bearing member, and it is opposed to the surface of the latent image bearing member through the distance for the development.

In either of the methods, a developing bias is applied between the developer carrying member and an electrically conductive support base of the latent image bearing member for causing the toner to selectively adhere to the latent image. The developing bias may include a DC component alone, or include a DC component and an AC component superposed one on the other.

Where a multi-color toner image is formed by superposing a plurality of images developed on a single photosensitive member by a plurality of developing units, there is a possibility that a toner image developed by one of the developing units is touched and disturbed by the other inactive developing units in the contact development method in which the developer carried on the surface of the developer carrying member is brought into contact with the latent image, regardless of whether the developer is the two-component developer or the single-component developer. For prevention of such a problem, there is proposed an arrangement such that the inactive developing units are temporarily retracted away from the latent image bearing member with the use of eccentric cam mechanisms (see, for example, Japanese Unexamined Patent Publication No. HEI9(1997)-274386).

For the visualization of the electrostatic latent image formed on the surface of the latent image bearing member, the developer carried on the surface of the developer carrying member is transported to the latent image bearing member to cause the developer electrostatically adhere to the electrostatic latent image. At this time, a part of the developer not adhering to the latent image on the latent image bearing member, i.e., a part of the developer not used for the development, is fed back into the developer tank by the rotation of the developer carrying member, then mixed with the developer in the developer tank, and carried again on the surface of the developer carrying member to be transported to the latent image bearing member, regardless of whether the developer is the two-component developer or the single-component developer.

It is ideal that the developer not used for the development but fed back into the developer tank is all released from the surface of the developer carrying member and then sufficiently mixed with the toner in the developer tank, and carried again on the surface of the developer carrying member to be transported to the latent image bearing member.

In practice, however, the developer is liable to stagnate below the developer carrying member and around the developer feeding member which feeds the developer to the developer carrying member. This makes it difficult to mix or replace the developer with a virgin developer.

More specifically, a great amount of the developer stagnates in the vicinity of the developer carrying member and the developer feeding member without replacement during a prolonged use, and is not sufficiently mixed with the virgin developer.

On the other hand, a part of the developer to be carried on the developer carrying member and fed to the latent image bearing member is generally present adjacent to the developer carrying member and the developer feeding member. Therefore, the developer present adjacent to the developer carrying member and the developer feeding member is more liable to be repeatedly transported by the developer carrying member and fed back into the developer tank without use for the development. For this reason, a ratio of the developer repeatedly transported and fed back into the developer tank without use for the development becomes more higher.

The developer present adjacent to the developer carrying member and the developer feeding member is repeatedly subjected to stresses and, therefore, degraded to have a reduced fluidity. This makes it more difficult to properly circulate the developer, resulting in a vicious circle.

The degraded developer has variations in electrostatic property, fluidity and agglomeration property as compared with the virgin developer. As a result, the developer carried on the developer carrying member and transported to the latent image has significant variations in electric charge amount, so that the electric charge amount distribution is broadened. Further, the physical fluidity is varied, leading to variations in development characteristics. This results in lower image density and image roughness.

The arrangement proposed in Japanese Unexamined Patent Publication No. HEI8(1996)-278698 promotes the circulation of the developer by the screw provided in the developer container, but is less effective for circulating the developer stagnating in the vicinity of the developer carrying member and the developer feeding member.

The arrangement proposed in Japanese Unexamined Patent Publication No. HEI9(1997)-274386 prevents the disturbance of the toner image developed by the one developing unit by retracting the other inactive developing units away from the latent image bearing member, but does not prevent the stagnation of the developer.

SUMMARY OF THE INVENTION

In view of the foregoing, the present invention is directed to an image forming apparatus which prevents uneven image density and image roughness which may otherwise occur due to the stagnation of the developer.

According to the present invention, there is provided an image forming apparatus, which includes: a latent image bearing member on which an electrostatic latent image is to be formed; a developing unit which contains a developer and performs a development process to develop the electrostatic latent image formed on the latent image bearing member; and a movement mechanism which moves the developing unit toward the latent image bearing member when the development process is performed, and moves the developing unit away from the latent image bearing member and changes the attitude of the developing unit with respect to the latent image bearing member when the development process is not performed.

According to the present invention, the developing unit is moved away from the latent image bearing member and its attitude is changed with respect to the latent image bearing member when the development process is not performed. Therefore, the developer is forcibly fluidized in the developing unit for prevention of the stagnation of the developer. This prevents the uneven image density and the image roughness which may otherwise occur when a part of the developer is repeatedly used to be degraded.

BRIEF DESCRIPTION OF THE DRAWINGS

FIG. 2A is a top plan view, FIG. 2B is a side view and FIG. 2C is a sectional view, of a developing unit provided in the image forming apparatus shown in FIG. 1.

DETAILED DESCRIPTION OF THE PREFERRED EMBODIMENTS

Figure 1:
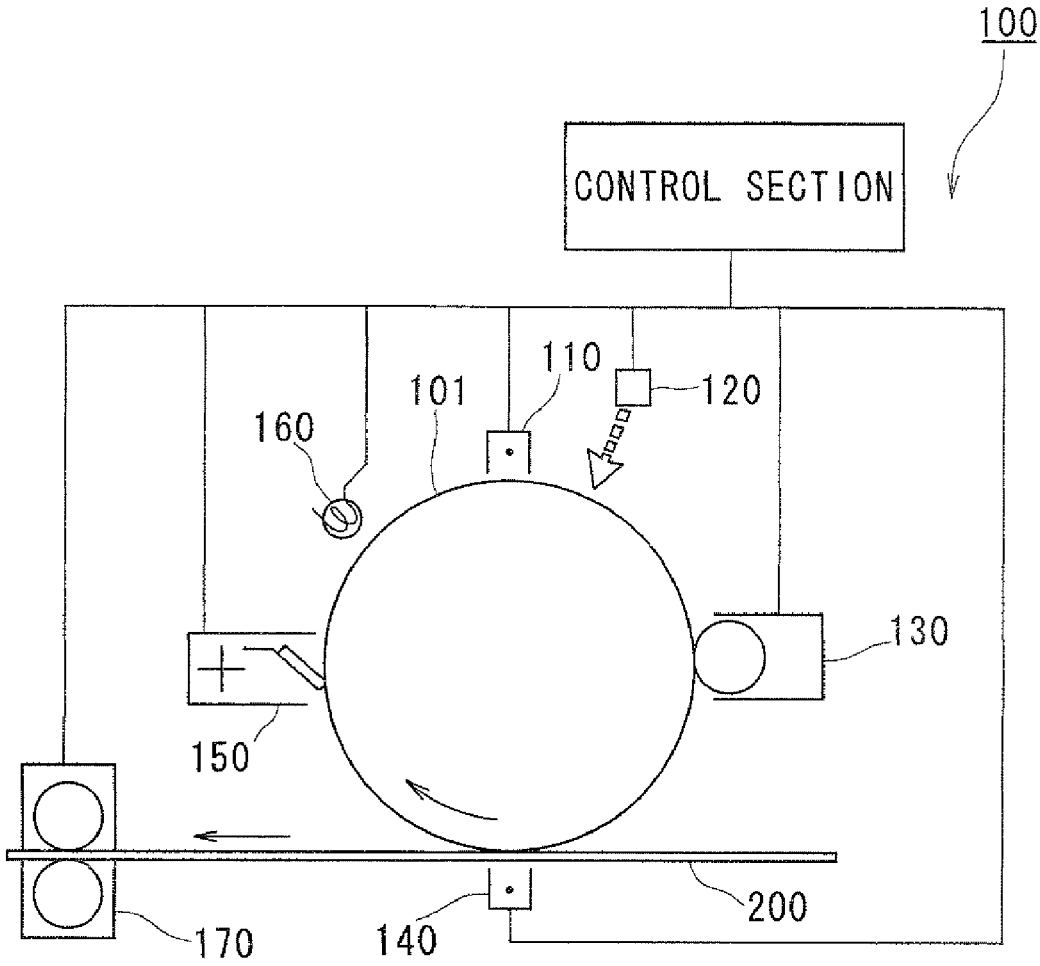
FIG. 1 is an explanatory diagram showing the overall construction of an image forming apparatus according to Embodiment 1 of the present invention.

An inventive image forming apparatus includes: a latent image bearing member on which an electrostatic latent image is to be formed; a developing unit which contains a developer and performs a development process to develop the electrostatic latent image formed on the latent image bearing member; and a movement mechanism which moves the developing unit toward the latent image bearing member when the development process is performed, and moves the developing unit away from the latent image bearing member and changes the attitude of the developing unit with respect to the latent image bearing member when the development process is not performed.

In the inventive image forming apparatus, the latent image bearing member is defined as a photoconductive member on which an image to be formed is recorded in the form of an electrostatic latent image by removing charges from the photoconductive member through irradiation with light.

The developing unit is defined as a member which visualizes the electrostatic latent image formed on the latent image bearing member by the developer contained therein.

The developer is defined as a material for the visualization of the electrostatic latent image. Examples of the developer include a two-component developer including a toner and a carrier, and a single-component developer including a toner alone.

The movement mechanism is defined as a drive mechanism which moves the developing unit and changes the attitude of the developing unit with respect to the latent image bearing member. The movement mechanism may include a control section which controls the driving of the movement mechanism.

In the inventive image forming apparatus, the developing unit includes a container which contains the developer, and a developer carrying member which is driven so as to carry the developer thereon from the container to the latent image bearing member. When the developing unit is moved away from the latent image bearing member, the movement mechanism may change the attitude of the developing unit so that a part of the developer present adjacent to the developer carrying member flows into the container.

With this arrangement, the developer once carried on the developer carrying member and fed back into the developing unit without use for the development is caused to forcibly flow into the container, and mixed with the developer present in the container and any other parts of the developing unit. In a conventional image forming apparatus, the developer fed back into the developing unit without use for the development is liable to stagnate in the vicinity of the developer carrying member, particularly, below the developer carrying member. However, the arrangement described above can prevent the developer fed back into the developing unit from stagnating in the vicinity of the developer carrying member.

The developer fed back into the developing unit is mixed with the toner present in the container and any other parts of the developing unit, whereby the degradation of the developer is prevented which may otherwise be caused by the repeated use of a part of the developer. Therefore, the inventive image forming apparatus ensures proper image formation substantially without degradation of image quality for a long period of time.

In the aforementioned arrangement adapted to change the attitude of the developing unit so as to cause the developer present adjacent to the developer carrying member to flow into the container, the developer carrying member may be driven in a state such that the developing unit is located away from the latent image bearing member with its attitude changed. Thus, the developer present adjacent to the developer carrying member is agitated to more speedily flow into the container.

With this arrangement, even if the developer fed back into the developing unit without use for the development stagnates in the vicinity of the developer carrying member, the stagnating developer can be agitated to be fluidized by driving the developer carrying member with the attitude of the developing unit changed. This more reliably prevents the developer from stagnating in the vicinity of the developer carrying member.

In the inventive image forming apparatus, the movement mechanism may include a cam to be brought into contact with the developing unit, and a rotative driving means which rotates the cam about an axis.

With this arrangement, the movement mechanism has a very simple structure and, therefore, occupies a smaller space in the image forming apparatus. With the simple structure, the movement mechanism is advantageous for reliable operation and for prevention of malfunction.

In the inventive image forming apparatus, the movement mechanism may include a cam, a rotative driving means which rotates the cam about an axis, and an arm which is pivoted to move the developing unit by following the rotation of the cam.

With this arrangement, the developing unit is moved by the arm which is pivoted by following the rotation of the cam. This makes it possible to move the developing unit in any of various movement patterns depending upon the structural design of the arm.

The inventive image forming apparatus may include a plurality of pairs of the developing unit and the movement mechanisms. With the provision of the plural pairs of the developing unit and movement mechanism, the inventive image forming apparatus is provided as a full color image forming apparatus. The full color image forming apparatus is adapted to form a multi-color toner image by superposing toner images formed by the respective developing units. Therefore, if even one of the developing units fails to properly perform its function due to deterioration of the developer, the quality of the resulting image is significantly influenced.

That is, it is important that the respective developing units properly perform their functions in the full color image forming apparatus. Therefore, the present invention which prevents the degradation of the developer is more effective.

In the inventive image forming apparatus, the developer may be a nonmagnetic single-component developer. In the case of the nonmagnetic single-component developer, there is no need to provide an auger mechanism which is otherwise needed in the case of the two-component developer for agitating and mixing the carrier and the toner. Thus, the structure of the developing unit can be simplified.

Without the provision of the auger mechanism, there would be a fear of the stagnation of the developer. According to the present invention, as described above, the developing unit is moved away from the latent image bearing member and its attitude is changed with respect to the latent image bearing member when the development process is not performed. This prevents the stagnation of the developer, so that the present invention is more effective.

The nonmagnetic single-component developer, which does not contain magnetic particles such as of magnetite, is advantageous for formation of a vivid full-color image free from turbidity.

Image forming apparatuses according to embodiments of the present invention will be described in detail with reference to the attached drawings. In the respective embodiments to be described, below, like components will be denoted by like reference numerals.

Embodiment 1

Figure 2A:
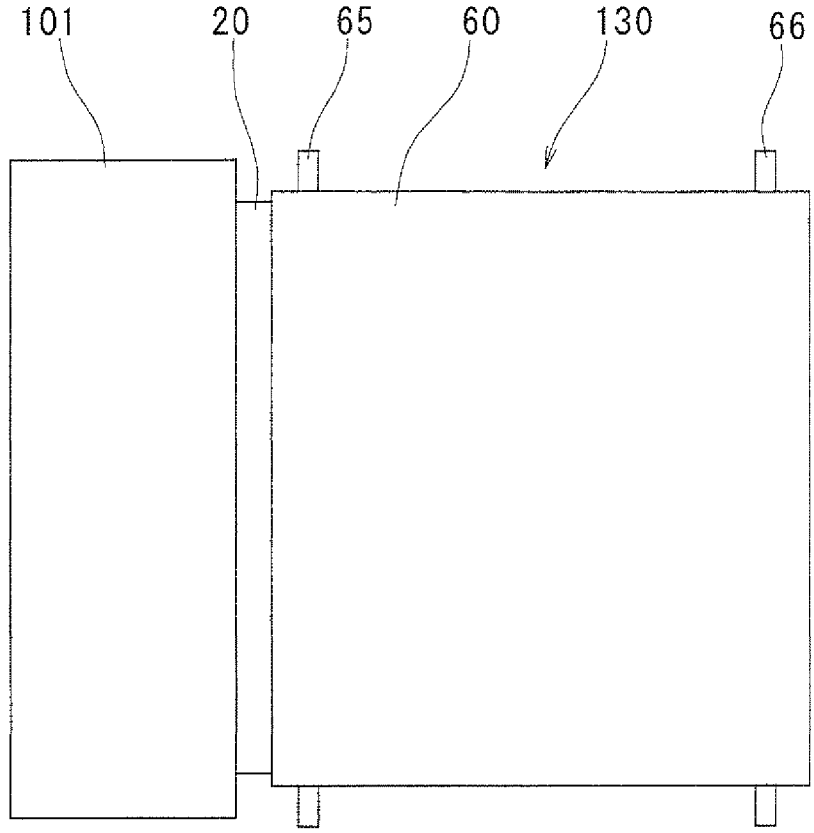
FIGS. 2A-2C are explanatory diagrams, particularly
Figure 2B:
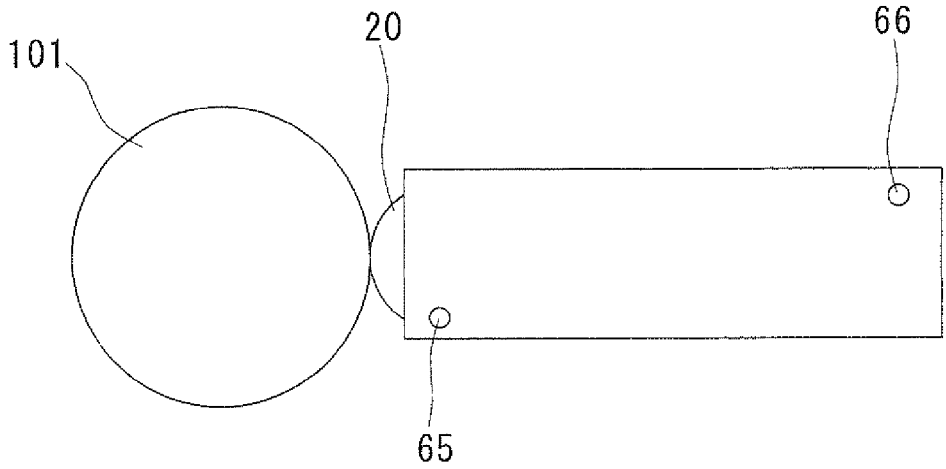
Figure 2C:
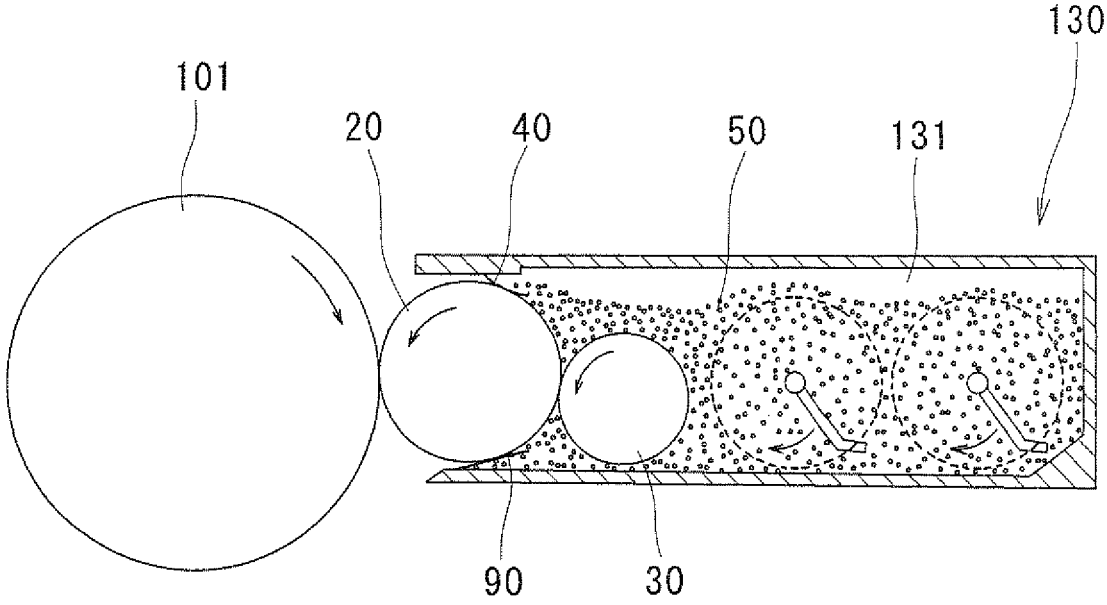
Figure 3:
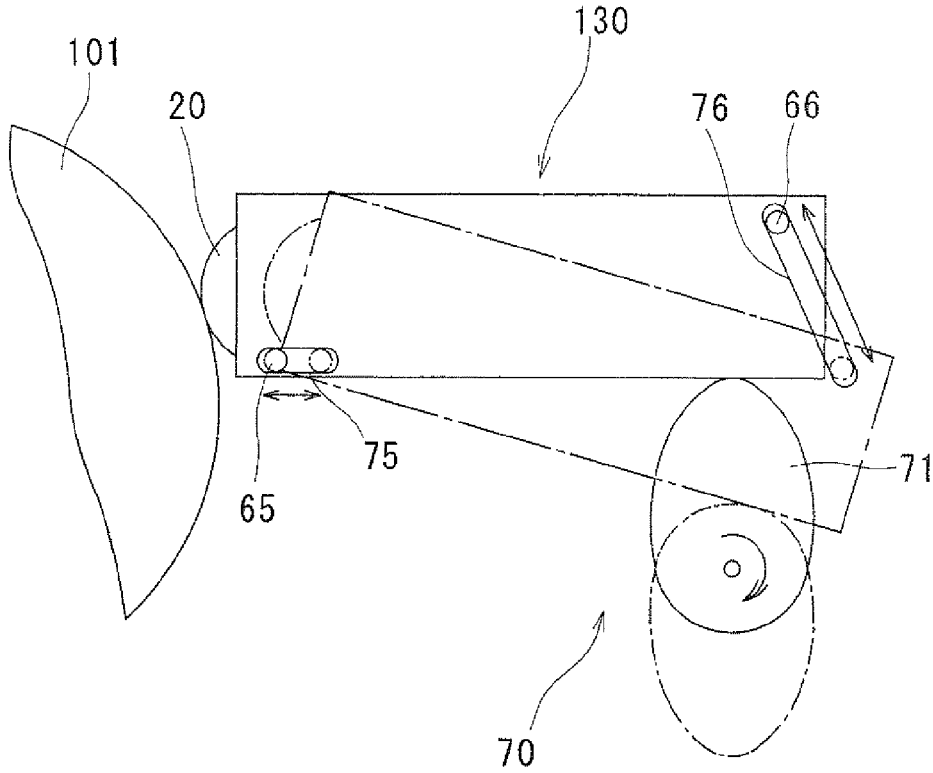
FIG. 3 is an explanatory diagram showing the state of the developing unit of FIGS. 2A-2C observed when the developing unit is located away from a photosensitive member with its attitude changed.

FIG. 1 is an explanatory diagram showing the overall construction of an image forming apparatus according to Embodiment 1 of the present invention. FIG. 2 is an explanatory diagram of a developing unit provided in the image forming apparatus shown in FIG. 1. FIG. 3 is an explanatory diagram showing the state of the developing unit of FIG. 2 observed when the developing unit is located away from a photosensitive member with its attitude changed.

As shown in FIG. 1, the image forming apparatus 100 according to Embodiment 1 of the present invention includes a photosensitive member 101 serving as a latent image bearing member, an charger 110, an exposure means 120, a developing unit 130, a transfer unit 140, a cleaning means 150, a diselectrifying means 160, a fixing unit 170 and a control section which comprehensively controls these components.

The photosensitive member 101 is supported rotatably about an axis, and is driven to be rotated in an arrow direction by a driving means not shown. The driving means includes, for example, a motor and a reduction gear mechanism. A driving force of the driving means is transmitted to an electrically conductive support member serving as a core of the photosensitive member 101, whereby the photosensitive member 101 is driven to be rotated at a predetermined circumferential speed.

The charger 110, the exposure means 120, the developing unit 130, the transfer unit 140, the cleaning means 150 and the diselectrifying means 160 are arranged in this order from an upstream side to a downstream side with respect to the rotation direction of the photosensitive member 101 along an outer peripheral surface of the photosensitive member 101.

The charger 110 is an electrifying means which electrifies the outer peripheral surface of the photosensitive member 101 at a predetermined potential. The charger 110 includes a charger wire mechanism such as a corotron or a scorotron, or an electrifying roller or an electrifying brush of a contact type.

When the photosensitive member 101 is driven to be rotated in the arrow direction by the driving means, the surface of the photosensitive member 101 is evenly electrified at a predetermined positive or negative potential by the charger 110.

The exposure means 120 includes a light source such as a semiconductor laser, and is adapted to irradiate the surface of the photosensitive member 101 with a laser beam outputted from the light source through a space between the charger 110 and the developing unit 130 to expose the electrified outer peripheral surface of the photosensitive member 101 according to image information. The laser beam is repeatedly scanned in a main scanning direction defined parallel to the rotation axis of the photosensitive member 101, whereby surface electric charges are removed from surface portions of the photosensitive member 101 irradiated with the laser beam according to exposure light amounts. Thus, differences in surface potential occur between the surface portions of the photosensitive member 101 irradiated with the laser beam and surface portions of the photosensitive member 101 not irradiated with the laser beam, whereby an electrostatic latent image is formed on the surface of the photosensitive member 101.

The developing unit 130 is a developing means which develops the electrostatic latent image formed on the surface of the photosensitive member 101 through the electrification and the exposure with a developer, and is provided in closely opposed relation to the photosensitive member 101 for supplying the toner (developer) to the outer peripheral surface of the photosensitive member 101 and causing the toner to adhere to the electrostatic latent image on the photosensitive member 101 for visualization of the electrostatic latent image in the form of a toner image.

On the other hand, a transfer paper sheet 200 is transported to be fed between the photosensitive member 101 and the transfer unit 140 by a transport means not shown in synchronism with the exposure of the photosensitive member 101 and the development, and the toner image is transferred from the photosensitive member 101 onto the transfer paper sheet 200 by the transfer unit 140. The transfer unit 140 may be an charger such as a corotron which applies electric charges of a polarity opposite to that of the toner to the transfer paper sheet 200, or may be an electrically conductive contact transfer roller which is biased to a polarity opposite to that of the toner.

After this transfer step, a part of the toner remaining on the photosensitive member 101 is removed from the outer peripheral surface of the photosensitive member 101 by the cleaning means 150, and recovered. The cleaning means 150 includes a cleaning blade which scrapes the remaining toner away from the outer peripheral surface of the photosensitive member 101, and a recovery casing which contains the toner scraped away by the cleaning blade.

After this cleaning step, the photosensitive member 101 is entirely exposed by the diselectrifying means 160, whereby a residual potential is removed for the next image formation.

On the other hand, the transfer paper sheet 200 having the toner image transferred thereto in the transfer step is transported to the fixing unit 170, and the transferred toner image is fixed to the transfer paper sheet 200. The fixing unit 170 includes, for example, a heat roller having a heat lamp incorporated therein, and a press roller kept in contact with the heat roller. The transfer paper sheet 200 is passed through a press contact portion (fixing nip) between the heat roller and the press roller, whereby the toner image is fused on the transfer paper sheet 200 to be fixed on the transfer paper sheet 200. The transfer paper sheet 200 having the toner image fixed thereon is outputted from the image forming apparatus 100 by the transport means not shown. Thus, an image formation process sequence is completed.

Next, the structure of the developing unit 130 provided in the image forming apparatus 100 will be described with reference to FIGS. 2A-2C and 3. FIGS. 2A-2C are explanatory diagrams, particularly FIG. 2A is a top plan view, FIG. 2A is a side view and FIG. 2C is a sectional view, of the developing unit 130 provided in the image forming apparatus 100. FIG. 3 shows the state of the developing unit 130 of FIGS. 2A-2C observed when the developing unit 130 is located away from the photosensitive member 101 with its attitude changed by a movement mechanism.

As shown in FIGS. 2A-2C, the developing unit 130 is adapted to feed a toner 50 (nonmagnetic single-component developer) to the vicinity of a developing roller 20 (developer carrying member) from a toner container 131 by a means of an agitator or the like. A toner feed roller 30 (developer feeding member) is pressed against the developing roller 20. The toner feed roller 30 is rotated in the same direction as the developing roller 20. That is, surface portions of the toner feed roller 30 and the developing roller 20 opposed to each other are moved in opposite directions.

A voltage is applied to the toner feed roller 30 by a bias voltage source not shown. The voltage electrically acts on the toner 50 to push the toner 50 toward the developing roller 20. If the toner 50 is a negative toner, for example, a significantly great bias voltage is applied to a negative electrode.

The toner 50 is triboelectrically contact-charged by the toner feed roller 30 and fed to the developing roller 20 by the bias voltage to be formed into a toner layer, which is transported to be brought into contact with a toner layer restricting blade 40 (developer amount restricting member) by the rotative movement of the developing roller 20. The toner layer restricting blade 40 is an electrically conductive plate member having opposite end portions, one of which is fixed to the vicinity of an upper opening of the developing unit 130 and the other of which is bent 90 degrees. A curved intermediate portion between the opposite end portions of the toner layer restricting blade 40 is resiliently pressed in contact with the developing roller 20.

The electrical charge amount and the thickness of the toner layer carried on the developing roller 20 are restricted to predetermined levels by properly setting the contact pressure and the contact position at which the toner layer restricting blade 40 abuts against the developing roller 20. A predetermined bias (which may be the same bias potential) with respect to the developing roller 20 is applied to the toner layer restricting blade 40, and the toner layer restricted in electrical charge amount and thickness is transported to a developing area (i.e., an area opposed to the photosensitive member 101 having the electrostatic latent image formed thereon) and subjected to a development process.

A part of the toner layer carried on the developing roller 20 and not used for the development of the electrostatic latent image in the development process is fed back into the toner container 131 through a leak prevention sheet 90 provided in a lower opening of the developing unit 130 by the rotation of the developing roller 20. The toner layer thus fed back into the toner container 131 is scraped away from the surface of the developing roller 20 by the toner feed roller 30, and mixed with the other toner in the toner container 131.

Next, the structure and the operation of the developing unit 130 will be described in detail. Table 1 shows exemplary structures of the photosensitive member 101 and the developing unit 130 and exemplary conditions to be employed in this embodiment.

The photosensitive member 101 is a drum of a negatively electrified type which has a diameter of about 30 mm and is electrified at a surface potential of about −600 V with its electrically conductive base being grounded. The photosensitive member 101 is rotated at a circumferential speed of about 140 mm/s in an arrow direction, and is exposed by the exposure means 120 for the formation of the electrostatic latent image.

The developing roller 20 has a diameter of about 16 mm, and is composed of an electrically conductive urethane rubber containing an electrically conductive agent such as a carbon black and having a volume resistivity of about $10^6$ Ωcm and a JIS-A hardness of about 50 to about 60 degrees. The developing roller 20 is rotated at a circumferential speed of about 210 mm/s in an arrow direction. The developing roller 20 has an electrically conductive support member (such as of a stainless steel or an electrically conductive resin) having a diameter of about 8 mm. A voltage of about −300 V is applied to the developing roller 20 through a shaft of the electrically conductive support member by a developing bias voltage source. The developing roller 20 is kept in press contact with the photosensitive drum 101 via the toner layer with a developing nip width being set to about 1.5 mm.

The toner feed roller 30 has a diameter of about 14 mm, and functions to agitate the toner 50 and to remove the toner layer from the developing roller 20 after the development. The toner feed roller 30 is composed of an electrically conductive urethane foam having a volume resistivity of about $10^5$ Ωcm and a cell density of about 3/mm. The toner feed roller 30 is rotated at a circumferential speed of about 125 mm/s in an arrow direction. A voltage of about −450 V is applied to the toner feed roller 30 via a shaft of an electrically conductive support member (such as of a stainless steel or an electrically conductive resin) by a feed bias voltage source. The toner feed roller 30 contacts the developing roller 20 with a contact depth of about 0.5 to about 1 mm.

The toner 50 is preliminarily negatively electrified by the toner feed roller 30 to adhere to the surface of the developing roller 20, and formed into a toner layer by the rotation of the developing roller 20. The toner layer is transported to be brought into contact with the toner layer restricting blade 40. The toner layer restricting blade 40 is an electrically conductive plate member (such as of a stainless steel, a phosphor bronze or an electrically conductive resin) having a thickness of about 0.1 mm. The toner layer restricting blade 40 has a cantilever leaf spring structure having a free end located upstream with respect to the rotation direction of the developing roller 20, and abuts against the developing roller 20 with a linear pressure of about 15 to about 30 gf/cm. A voltage of about −450 V is applied to the toner layer restricting blade 40 by a toner restricting blade bias voltage source.

The toner layer carried on the developing roller 20 is controlled so as to have a toner adhering amount of about 0.6 to about 0.8 mg/cm$^2$ and a toner charge amount of about −10 to

TABLE 1

| Components | Photosensitive member | Developing roller | Feed roller | Toner layer restricting blade |
|---|---|---|---|---|
| Material | OPC | Electrically conductive urethane | Electrically conductive urethane (sponge) | Stainless steel |
| Dimensions (mm) | ϕ30 | ϕ16 | ϕ14 | 0.1 (thickness) |
| Resistance (Ωcm) | — | About $10^6$ | About $10^5$ | — |
| Hardness (°) | — | 55° (JIS A) | 68° (ASKA-F) | — |
| Bias potential (V) | (Dark potential) −600 | −300 | −450 | −450 |
| Circumferential speed (mm/s) | 140 | 210 | 125 | — |

about −15 μC/g by the toner layer restricting blade 40, and then transported to the developing area opposed in contact with the photosensitive member 101 by the rotation of the developing roller 20. Thus, a contact reversal development is achieved.

The leak preventing sheet 90 is provided in the lower opening of the developing unit 130 for preventing the leak of the toner from the toner container 131. The leak preventing sheet 90 is formed of a urethane sheet or a mylar film, for example, having a thickness of about 0.2 mm. Alternatively, the leak preventing sheet 90 may be formed of an electrically conductive film such as an aluminum vapor-deposited film. In this case, the leak preventing sheet 90 doubles as a toner charge removing means which diselectrifies the toner layer fed back into the toner container 131 without use for the development by applying the same bias potential as that of the shaft of the developing roller 20 or a bias potential higher by about +50 V than that of the shaft of the developing roller 20 to the leak preventing sheet 90.

The toner 50 to be used in this embodiment is preferably a so-called high resistance toner. More specifically, a pelletized material for the toner 50 has an electrical resistance of about $10^{10}$ Ωcm. The toner 50 is prepared by mixing 80 to 90 parts by weight of a polyester resin or a styrene-acryl copolymer resin as a base resin and 4 to 10 parts by weight of a carbon black, kneading the resulting mixture, adding 0 to 5 parts by weight of a charge control agent (CCA) and a very small amount of a vulcanization control agent to the mixture, pulverizing the resulting mixture, and adding 0.2 to 2 parts by weight of an external additive such as silica to the mixture.

The toner container 131 of the developing unit 130 has a generally flat interior surface. A total of four guide pins 65, 66 are provided on opposite side surfaces of the developing unit 130 (two guide pins 65, 66, i.e., a front guide pin 65 and a rear guide pin 66, are provided on each of the opposite side surfaces of the developing unit 130) for defining a positional relationship between the developing unit 130 and the photosensitive member 101 in the image forming apparatus 100. Of the four guide pins 65, 66, the front guide pins 65 are located closer to the photosensitive member 101 in the vicinity of lower edges of the side surfaces, and the rear guide pins 66 are located apart from the photosensitive member 101 in the vicinity of upper edges of the side surfaces. That is, there is a height difference between the front guide pins 65 and the rear guide pins 66.

On the other hand, as shown in FIG. 3, front guide channels 75 and rear guide channels 76 are provided in the image forming apparatus 100, and respectively engage the guide pins 65, 66 of the developing unit 130 so as to define a movable range of the developing unit 130 in the image forming apparatus 100. The rear guide channels 76 are located apart from the photosensitive member 101 so as to guide the developing unit 130 obliquely downward, and the front guide channels 75 are located closer to the photosensitive member 101 as extending horizontally.

As shown in FIG. 3, a movement mechanism 70 including a cam 71 and a rotative driving mechanism (not shown) which rotates the cam 71 about an axis are provided in the image forming apparatus 100, and the cam 71 supports a lower surface of the developing unit 130. The developing unit 130 is constantly urged toward the cam 71 by an urging means not shown. Therefore, when the cam 71 is rotated 180 degrees about the axis by the rotative driving means, the developing unit 130 is moved rearward away from the photosensitive member 101 to a position indicated by an alternate long and short dashed lines in FIG. 3 along the guide channels 75 with its rear portion moved obliquely downward along the guide channels 76.

In a non-development period during which the development process is not performed, the attitude of the developing unit 130 is thus changed with respect to the photosensitive member 101, so that the developing unit 130 is moved away from the photosensitive member 101 with its rear portion lowered. Therefore, a part of the toner 50 present adjacent to the developing roller 20 and the toner feed roller 30 flows toward a rear portion of the toner container 131 to be mixed with the other part of the toner 50 in the non-development period.

In a development period during which the development process is performed, the cam 71 is rotated 180 degrees about the axis again to push up the rear portion of the developing unit 130, whereby the developing unit 130 is moved back to the previous position at which the developing roller 20 and the photosensitive member 101 are located adjacent to each other or in contact with each other. In this state, the developing roller 20 and the toner feed roller 30 are driven and the aforementioned biases are applied, whereby the electrostatic latent image on the photosensitive member 101 is developed with the toner 50.

The part of the toner 50 fed back into the toner container 131 without use for the development is liable to stagnate in the vicinity of the developing roller 20 and the toner feed roller 30. However, the attitude of the developing unit 130 is repeatedly changed with respect to the photosensitive member 101 by alternately repeating the development period and the non-development period, whereby a stress is repeatedly applied to the toner 50 present adjacent to the developing roller 20 and the toner feed roller 30 for effective fluidization of the toner 50.

The developing roller 20 and the toner feed roller 30 may be driven in a state such that the developing unit 130 is located away from the photosensitive member 101 with its attitude changed with respect to the photosensitive member 101, whereby the toner 50 present adjacent to the developing roller 20 and the toner feed roller 30 is agitated to be fluidized.

Thus, the toner 50 present adjacent to the developing roller 20 and the toner feed roller 30 is more reliably caused to flow to the rear portion of the toner container 131.

In the non-development period, as required, the developing roller 20 and the toner feed roller 30 may be driven to be rotated in a direction opposite to that in the development period, whereby a force acts on the stagnating toner 50 in a direction different from that in the development period. This eliminates the stagnation.

If a component to be driven in association with the rotative driving of the developing roller 20 and the toner feed roller 30 is provided and the reverse rotation of that component is undesirable for structural reasons, a one-way clutch may be employed for prevention of the reverse rotation of the component.

According to this embodiment, the developing unit 130 is thus moved away from the photosensitive member 101 to change the attitude of the developing unit 130 with respect to the photosensitive member 101 in the non-development period, whereby the part of the toner 50 present adjacent to the developing roller 20 and the toner feed roller 30 is forcibly fluidized to be mixed with the other part of the toner 50. This prevents the uneven image density and the image roughness which may otherwise occur when the stagnating toner 50 is repeatedly used to be degraded. Therefore, the image forming apparatus ensures proper image formation for a long period of time.

Embodiment 2

Figure 4:
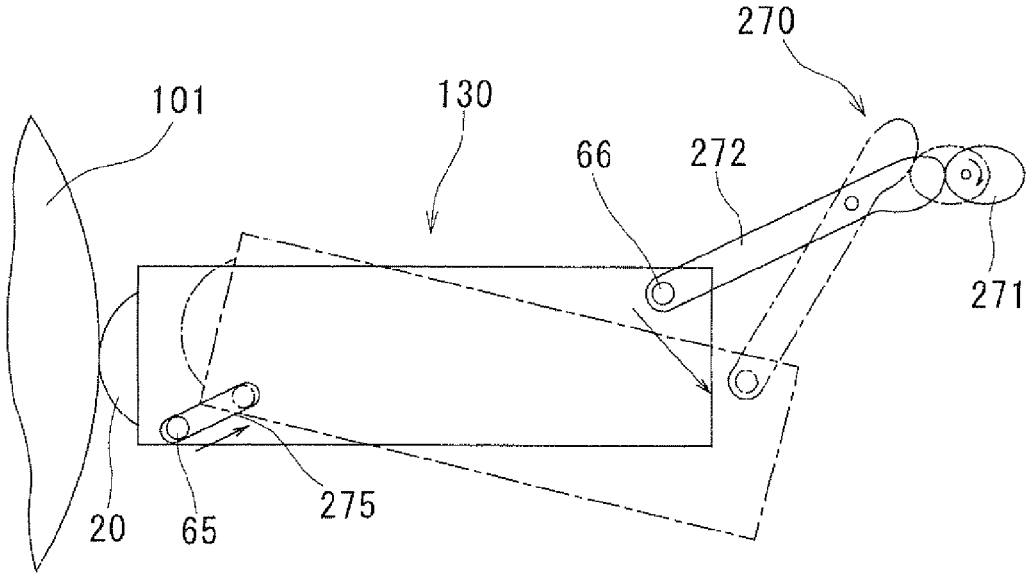
FIG. 4 is a diagram of an image forming apparatus according to Embodiment 2 of the present invention as corresponding to FIG. 3.

An image forming apparatus according to Embodiment 2 of the present invention will be described with reference to FIG. 4. FIG. 4 is a diagram of the image forming apparatus according to Embodiment 2 as corresponding to FIG. 3.

In the image forming apparatus of Embodiment 2, the developing unit 130 has the same construction as in Embodiment 1, but the guide channels and the movement mechanism provided in the image forming apparatus are modified.

In Embodiment 2, as shown in FIG. 4, a movement mechanism 270 includes a cam 271, a rotative drive mechanism (not shown) which rotates the cam 271 about an axis, and arms 272 which follow the rotation of the cam 271 to be pivoted. Further, guide channels 275 which guide the front guide pins 65 of the developing unit 130 obliquely upward are provided in the image forming apparatus, and the rear guide pins 66 respectively engage distal ends of the arms 272 in a rotatable manner. Further, the developing unit 130 is urged toward the photosensitive member 101 so as to be opposed to the photosensitive member 101.

In Embodiment 2, when the cam 271 is rotated 180 degrees, the arms 272 follow the rotation of the cam 271 to be pivoted obliquely downward, and the rear guide pins 66 of the developing unit 130 are pushed obliquely downward by the pivoted arms 272. At this time, the front guide pins 65 of the developing unit 130 are moved obliquely upward along the guide channels 275. Thus, a front portion of the developing unit 130 is moved obliquely upward away from the photosensitive member 101 along the guide channels 275, while a rear portion of the developing unit 130 is pushed obliquely downward to the position indicated by an alternate long and short dashed lines in FIG. 4 by the arms 272.

In the non-development period, the developing unit 130 is thus moved away from the photosensitive member 101 with its attitude being changed with respect to the photosensitive member 101 so as to lower its rear portion. Therefore, the part of the toner 50 present adjacent to the developing roller 20 and the toner feed roller 30 flows to the rear portion of the toner container 131 to be mixed with the other part of the toner 50 in the non-development period.

When the cam 271 is rotated 180 degrees again in the development period, the arms 272 are lifted obliquely upward by the aforementioned urging force to move back the developing unit 130 to the previous position at which the developing roller 20 and the photosensitive member 101 are located adjacent to each other or in contact with each other.

In Embodiment 2, the attitude of the developing unit 130 is repeatedly changed with respect to the photosensitive member 101 by alternately repeating the developing period and the non-developing period, whereby the toner 50 present adjacent to the developing roller 20 and the toner feed roller 30 is effectively fluidized.

Further, the developing roller 20 and the toner feed roller 30 may be driven in a state such that the developing unit 130 is located away from the photosensitive member 101 with its attitude changed, whereby the toner 50 present adjacent to the developing roller 20 and the toner feed roller 30 is reliably agitated to be fluidized. The other arrangement of the image forming apparatus according to Embodiment 2 is the same as that of the image forming apparatus 100 according to Embodiment 1.

Embodiment 3

Figure 5:
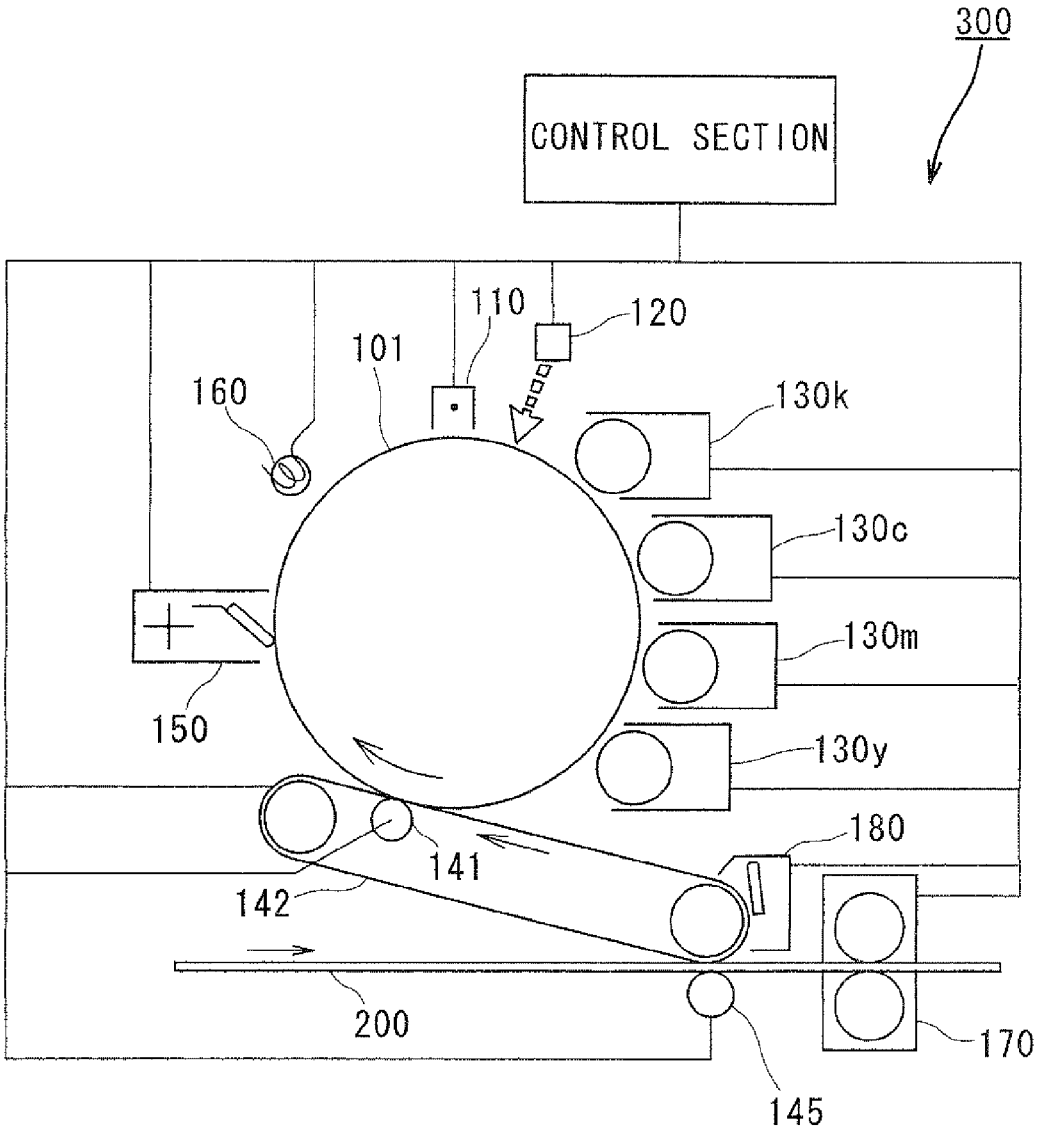
FIG. 5 is an explanatory diagram showing the overall construction of an image forming apparatus according to Embodiment 3 of the present invention.

An image forming apparatus according to Embodiment 3 of the present invention will be described with reference to FIG. 5. FIG. 5 is an explanatory diagram schematically showing the construction of the image forming apparatus according to Embodiment 3. The image forming apparatus according to Embodiment 3 is a full color image forming apparatus including plural sets of developing units and movement mechanisms having the same constructions as those in Embodiment 1 or 2.

As shown in FIG. 5, the image forming apparatus 300 according to Embodiment 3 includes a photosensitive member 101 serving as a latent image bearing member, an charger 110, an exposure means 120, a plurality of developing units 130*k*, 130*c*, 130*m*, 130*y*, a primary transfer unit 141, a secondary transfer unit 145, a cleaning means 150, a diselectrifying means 160, a fixing unit 170, a transfer belt cleaning means 180 and a control section which comprehensively controls these components.

The photosensitive member 101 is supported rotatably about an axis, and is driven to be rotated in an arrow direction by a driving means not shown. The driving means includes, for example, a motor and a reduction gear mechanism. A driving force of the driving means is transmitted to an electrically conductive support member serving as a core of the photosensitive member 101, whereby the photosensitive member 101 is driven to be rotated at a predetermined circumferential speed.

The charger 110, the exposure means 120, the developing units 130*k*, 130*c*, 130*m*, 130*y*, the primary transfer unit 141, the cleaning means 150 and the diselectrifying means 160 are arranged in this order from an upstream side to a downstream side with respect to the rotation direction of the photosensitive member 101 along an outer peripheral surface of the photosensitive member 101.

The charger 110 is an electrifying means which electrifies the outer peripheral surface of the photosensitive member 101 at a predetermined potential. The charger 110 includes a charger wire mechanism such as a corotron or a scorotron, or an electrifying roller or an electrifying brush of a contact type. When the photosensitive member 101 is driven to be rotated in the arrow direction by the driving means, the surface of the photosensitive member 101 is evenly electrified at a predetermined positive or negative potential by the charger 110.

The exposure means 120 includes a light source such as a semiconductor laser, and is adapted to irradiate the surface of the photosensitive member 101 with a laser beam outputted from the light source through a space between the charger 110 and the developing unit 130*k* to expose the electrified outer peripheral surface of the photosensitive member 101 according to image information. The laser beam is repeatedly scanned in a main scanning direction defined parallel to the rotation axis of the photosensitive member 101, whereby surface electric charges are removed from portions of the photosensitive member 101 irradiated with the laser beam according to exposure light amounts. Thus, differences in surface potential occur between the portions of the photosensitive member 101 irradiated with the laser beam and portions of the photosensitive member 101 not irradiated with the laser beam, whereby an electrostatic latent image is formed on the surface of the photosensitive member 101.

The developing units 130*k*, 130*c*, 130*m*, 130*y* are developing means which are each adapted to develop the electrostatic latent image formed on the surface of the photosensitive member 101 through the electrification and the exposure with a developer, and are provided in closely opposed relation to the photosensitive member 101 for supplying the toner (developer) to the outer peripheral surface of the photosensitive member 101 and causing the toner to adhere to the electrostatic latent image on the photosensitive member 101 for visualization of the electrostatic latent image in the form of a toner image. The developing units 130*k*, 130*c*, 130*m*, 130*y* may each have the same construction as the developing unit described in Embodiment 1 or 2, and may be adapted to be independently moved between a development position and a non-development position.

The primary transfer unit 141 is an electrically conductive contact transfer roller which applies charges of a polarity opposite to that of the toner to a primary transfer belt 142, and is adapted to primarily transfer the toner image from the photosensitive member 101 onto the primary transfer belt 142.

After this primary transfer step, a part of the toner remaining on the photosensitive member 101 is removed from the outer peripheral surface of the photosensitive member 101 by the cleaning means 150. The cleaning means 150 includes a cleaning blade which scrapes the remaining toner away from the outer peripheral surface of the photosensitive member 101, and a recovery casing which contains the toner scraped away by the cleaning blade.

After this cleaning step, the photosensitive member 101 is entirely exposed by the diselectrifying means 160, whereby the residual potential is removed for the next image formation.

In this embodiment, the development step and the primary transfer step are repeatedly performed by the respective developing units 130*k*, 130*c*, 130*m* and 130*y* to form a black toner image, a cyan toner image, a magenta toner image and a yellow toner image, which are superposed to form a multi-color toner image on the primary transfer belt 142.

More specifically, an image formation process sequence is performed for black as the first color by the developing unit 130*k*. That is, the developing unit 130*k* is located at the development position in closely opposed relation to the photosensitive member 101, and the other developing units 130*c*, 130*m*, 130*y* are each located at the non-development position away from the photosensitive member 101 with the attitude thereof changed with respect to the photosensitive member 101. In this state, the electrification step, the exposure step, the development step and the primary transfer step are performed for black, whereby the black toner image is formed on the primary transfer belt 142.

In turn, the developing unit 130*c* is located at the development position in closely opposed relation to the photosensitive member 101, and the other developing units 130*k*, 130*m*, 130*y* are each located at the non-development position away from the photosensitive member 101 with the attitude thereof changed with respect to the photosensitive member 101. In this state, the electrification step, the exposure step, the development step and the primary transfer step are performed for cyan as the second color, whereby the cyan toner image is superposed on the black toner image on the primary transfer belt 142.

The image formation process sequence is performed for magenta and yellow by the developing units 130*m*, 130*y*. Thus, the black toner image, the cyan toner image, the magenta toner image and the yellow toner image are superposed on the primary transfer belt 142, whereby the multi-color toner image is formed on the primary transfer belt 142.

The secondary transfer unit 145 secondarily transfers the multi-color toner image from the primary transfer belt 142 onto a transfer paper sheet 200 transported between the primary transfer belt 142 and the secondary transfer unit 145 by a transport means not shown. The secondary transfer unit 145 may be an charger such as a corotron which applies electric charges of a polarity opposite to that of the toner, or may be an electrically conductive contact transfer roller which is biased to a polarity opposite to that of the toner. A part of the toner not transferred onto the transfer paper sheet 200 in the secondary transfer step but remaining on the primary transfer belt 142 is removed and recovered by the transfer belt cleaning means 180 which is movable toward and away from the primary transfer belt 142.

On the other hand, the transfer paper sheet 200 having the multi-color toner image transferred thereto in the secondary transfer step is transported to the fixing unit 170, and the transferred multi-color toner image is fixed to the transfer paper sheet 200.

The fixing unit 170 includes, for example, a heat roller having a heat lamp incorporated therein, and a press roller kept in contact with the heat roller. The transfer paper sheet 200 is passed through a press contact portion (fixing nip) between the heat roller and the press roller, whereby the multi-color toner image is fused on the transfer paper sheet 200 to be fixed on the transfer paper sheet 200. The transfer paper sheet 200 having the multi-color toner image fixed thereto is outputted from the image forming apparatus 300 by the transport means not shown. Thus, the image formation process sequence is completed.

In order to provide a predetermined image quality, it is important that the respective developing units properly perform their functions in the full color image forming apparatus. In this embodiment, the developing units 130*k*, 130*c*, 130*m*, 130*y* are each located away from the photosensitive member 101 with the attitude thereof changed with respect to the photosensitive member 101 in the non-development period. Therefore, the toners in the developing units 130*k*, 130*c*, 130*m*, 130*y* are forcibly fluidized for suppression of the degradation thereof. Thus, the full color image forming apparatus ensures proper full-color image formation for a long period of time.

What is claimed is:

1. An image forming apparatus comprising:

a latent image bearing member on which an electrostatic latent image is to be formed;

a developing unit which contains a developer and performs a development process to develop the electrostatic latent image formed on the latent image bearing member; and a movement mechanism which moves the developing unit toward the latent image bearing member when the development process is performed, and moves the developing unit away from the latent image bearing member and changes an attitude of the developing unit with respect to the latent image bearing member when the development process is not performed, and wherein the movement mechanism includes a cam to be brought into contact with the developing unit, and a rotative driving means which rotates the cam about an axis.

2. An image forming apparatus as set forth in claim 1, wherein the developing unit includes a container which contains the developer, and a developer carrying member which is driven so as to carry the developer thereon from the container to the latent image bearing member; and the movement mechanism changes the attitude of the developing unit so that a part of the developer present adjacent to the developer carrying member flows into the container, when the developing unit is moved away from the latent image bearing member.

3. An image forming apparatus as set forth in claim 2, wherein the developer carrying member is driven in a state such that the developing unit is located away from the latent image bearing member with its attitude changed, whereby the part of the developer present adjacent to the developer carrying member is agitated to promote the flow of the developer into the container.

4. An image forming apparatus as set forth in claim 2, wherein the developer carrying member is driven in a first rotational direction to supply developer to the latent image bearing member when the developing unit is moved toward the latent image bearing member, and wherein the developer carrying member is rotated in a second rotational direction opposite to the first rotational direction when the developing unit is moved away from the latent image bearing member.

5. An image forming apparatus as set forth in claim 1, which includes a plurality of pairs of the developing unit and the movement mechanism.

6. An image forming apparatus as set forth in claim 1, wherein the developer is a nonmagnetic single-component developer.

7. An image forming apparatus comprising:

a latent image bearing member on which an electrostatic latent image is to be formed;

a developing unit which contains a developer and performs a development process to develop the electrostatic latent image formed on the latent image bearing member; and a movement mechanism which moves the developing unit toward the latent image bearing member when the development process is performed, and moves the developing unit away from the latent image bearing member and changes an attitude of the developing unit with respect to the latent image bearing member when the development process is not performed, and wherein the movement mechanism includes a cam, a rotative driving means which rotates the cam about an axis, and an arm which is pivoted to move the developing unit by following the rotation of the cam.

8. An image forming apparatus as set forth in claim 7, wherein the developing unit includes a container which contains the developer, and a developer carrying member which is driven so as to carry the developer thereon from the container to the latent image bearing member, and wherein the movement mechanism changes the attitude of the developing unit so that a part of the developer present adjacent to the developer carrying member flows further into the container when the developing unit is moved away from the latent image bearing member.

9. An image forming apparatus as set forth in claim 8, wherein the developer carrying member is driven in a state such that the developing unit is located away from the latent image bearing member with its attitude changed, whereby the part of the developer present adjacent to the developer carrying member is agitated to promote the flow of the developer into the container.

10. An image forming apparatus as set forth in claim 8, wherein the developer carrying member is driven in a first rotational direction to supply developer to the latent image bearing member when the developing unit is moved toward the latent image bearing member, and wherein the developer carrying member is rotated in a second rotational direction opposite to the first rotational direction when the developing unit is moved away from the latent image bearing member.

11. An image forming apparatus as set forth in claim 7, which includes a plurality of pairs of the developing unit and the movement mechanism.

12. An image forming apparatus as set forth in claim 7, wherein the developer is a nonmagnetic single-component developer.

* * * * *